US009404354B2

(12) United States Patent
Sugiura

(10) Patent No.: US 9,404,354 B2
(45) Date of Patent: Aug. 2, 2016

(54) CLOSED LOOP WELL TWINNING METHODS

(75) Inventor: Junichi Sugiura, Bristol (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 1003 days.

(21) Appl. No.: 13/525,241

(22) Filed: Jun. 15, 2012

(65) Prior Publication Data

US 2013/0333946 A1 Dec. 19, 2013

(51) Int. Cl.

| | |
|---|---|
| ***G01V 3/18*** | (2006.01) |
| ***E21B 44/00*** | (2006.01) |
| ***E21B 47/022*** | (2012.01) |
| ***E21B 7/04*** | (2006.01) |

(52) U.S. Cl.

CPC ..... *E21B 44/00* (2013.01); *E21B 7/046* (2013.01); *E21B 47/022* (2013.01)

(58) Field of Classification Search

CPC ..... E21B 44/00; E21B 47/022; E21B 7/046
USPC ..... 324/346
See application file for complete search history.

(56) References Cited

U.S. PATENT DOCUMENTS

| | | | | |
|---|---|---|---|---|
| 4,372,398 | A * | 2/1983 | Kuckes | 175/45 |
| 4,529,939 | A * | 7/1985 | Kuckes | 324/346 |
| 4,700,142 | A * | 10/1987 | Kuckes | G01V 3/26 166/66.5 |
| 4,791,373 | A * | 12/1988 | Kuckes | 324/346 |
| 4,845,434 | A * | 7/1989 | Kuckes et al. | 324/346 |
| 4,933,640 | A * | 6/1990 | Kuckes | 324/339 |
| 5,064,006 | A * | 11/1991 | Waters et al. | 175/45 |
| 5,084,678 | A * | 1/1992 | Hutin | 324/346 |
| 5,103,920 | A * | 4/1992 | Patton | E21B 47/02216 175/45 |
| 5,265,682 | A | 11/1993 | Russell et al. | |
| 5,305,212 | A * | 4/1994 | Kuckes | 702/7 |
| 5,603,386 | A | 2/1997 | Webster | |
| 6,089,332 | A | 7/2000 | Barr et al. | |
| 6,092,610 | A | 7/2000 | Kosmala et al. | |
| 6,651,496 | B2 | 11/2003 | Van Steenwyk et al. | |
| 6,857,484 | B1 | 2/2005 | Helms et al. | |
| 6,985,814 | B2 | 1/2006 | McElhinney | |
| 7,234,543 | B2 | 6/2007 | Shaaf | |
| 7,464,770 | B2 | 12/2008 | Jones et al. | |
| 7,506,696 | B2 | 3/2009 | Weston et al. | |
| 7,656,161 | B2 | 2/2010 | McElhinney | |
| 7,812,610 | B2 | 10/2010 | Clark et al. | |
| 7,932,718 | B1 * | 4/2011 | Wiegert | 324/247 |
| 7,950,473 | B2 | 5/2011 | Sugiura | |
| 7,967,081 | B2 | 6/2011 | Sugiura et al. | |
| 8,118,114 | B2 | 2/2012 | Sugiura | |
| 8,684,107 | B2 * | 4/2014 | Clark | 175/24 |
| 8,917,094 | B2 * | 12/2014 | Bittar et al. | 324/339 |
| 2004/0249573 | A1 * | 12/2004 | McElhinney | G01V 3/26 702/7 |
| 2007/0126426 | A1 * | 6/2007 | Clark et al. | 324/326 |
| 2009/0030615 | A1 * | 1/2009 | Clark | 702/7 |
| 2009/0201025 | A1 * | 8/2009 | McElhinney | 324/346 |
| 2009/0260878 | A1 * | 10/2009 | Morley et al. | 175/45 |
| 2011/0298462 | A1 * | 12/2011 | Clark et al. | 324/346 |
| 2011/0308859 | A1 * | 12/2011 | Bittar et al. | 175/45 |
| 2012/0013339 | A1 * | 1/2012 | Kuckes | 324/346 |

(Continued)

*Primary Examiner* — Jay Patidar

(57) ABSTRACT

Closed loop methods for drilling twin wells are disclosed. The disclosed method make use of a bottom hole assembly including a rotary steerable tool. An electrical current is induced in the target well. The corresponding magnetic field about the target well is measured in the twin well and used to guide drilling of the twin well.

18 Claims, 6 Drawing Sheets

(56) References Cited

U.S. PATENT DOCUMENTS

2012/0109527 A1 5/2012 Bespalov
2012/0158305 A1* 6/2012 Rodney et al. ..... 702/6
2013/0057287 A1* 3/2013 Le et al. ..... 324/346
2013/0069655 A1* 3/2013 McElhinney et al. ..... 324/346

* cited by examiner

CLOSED LOOP WELL TWINNING METHODS

CROSS REFERENCE TO RELATED APPLICATIONS

None.

FIELD OF THE INVENTION

Disclosed embodiments relate generally to methods for drilling subterranean wellbores and more particularly to closed loop methods for twinning subterranean wellbores.

BACKGROUND INFORMATION

In various well drilling operations it is desirable to estimate the location of a nearby wellbore. Examples of such operations include well intercept, well avoidance, well twinning, and relief well drilling operations.

Both passive and active magnetic ranging techniques are known in the oil field services industry. For example, U.S. Pat. Nos. 6,985,814 and 7,656,161 to McElhinney, disclose passive ranging methodologies for use in well twinning applications. The '814 patent makes use of remanent magnetization in a target well casing string while the '161 patent teaches a method for magnetizing the target well casing string prior to deployment in the target well.

U.S. Pat. No. 7,812,610 to Clark teaches a methodology in which a secondary electrical current is induced in the target wellbore casing string, e.g., via inducing a voltage across an insulative gap in the drill string located in the drilling wellbore. The secondary current in the target wellbore casing string further induces a magnetic field that may be measured in the drilling wellbore and used to estimate the location of the target. However, the need to stop drilling and make magnetic field measurements at three or more tool face angles can result in a time consuming drilling process. Further improvement is required.

SUMMARY

Closed loop methods for drilling a twin well are disclosed. The methods include rotary drilling the twin well with a drill string including a rotary steerable tool. An electrical current is induced in the target well while rotary drilling the twin well. The current may be induced in the target well, for example, by applying a voltage across an insulating gap in the BHA. The induced electrical current in turn induces a magnetic field about the target well that may be measured in the twin well. The measured magnetic field is processed while rotary drilling to obtain new rotary steerable tool settings which may be applied to change the drilling direction.

The disclosed embodiments may provide various technical advantages. For example, the disclosed methods may be used to steer the twin well automatically along a predetermined path with respect to the target well. No surface intervention is required. Such closed loop methods may therefore improve the efficiency of the drilling operation and significantly reduce the total time required to drill the twin well. The disclosed methods may further improve placement accuracy of the twin well with respect to the target well as the steering tool settings may be adjusted continually while drilling (e.g., at approximately 10 second intervals while drilling).

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Figure 1:
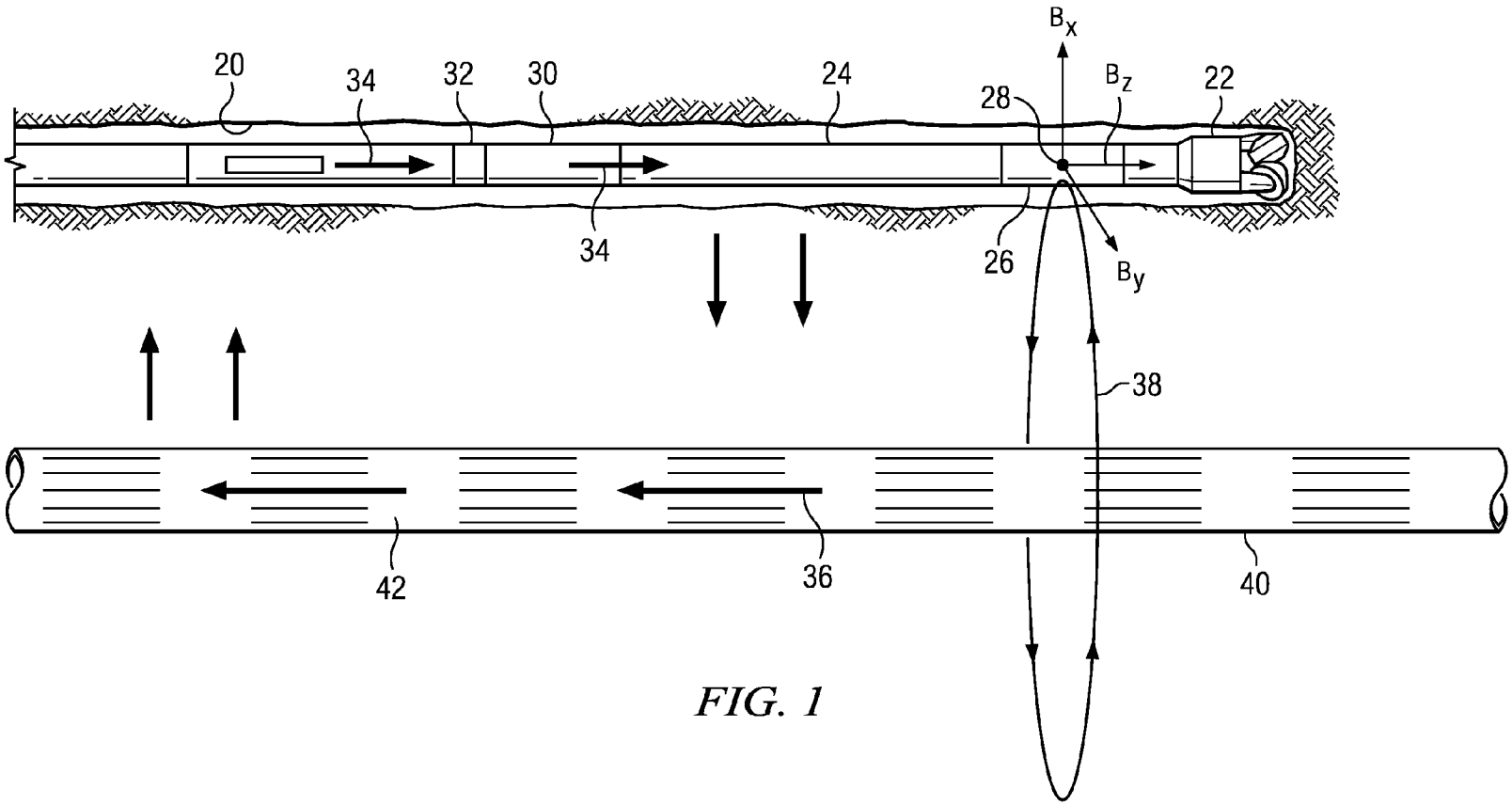
FIG. 1 depicts one example of a well twinning operation in which disclosed methods may be utilized.

FIG. 1 depicts one example of a well twinning operation in which a twin well 20 is being drilled along a direction that is approximately parallel with a cased target well 40. The bottom hole assembly (BHA) in the twin well 20 (also referred to herein as the drilling well) includes a drill bit 22 deployed below a rotary steerable tool 24. In the example twinning operation depicted, the BHA further includes an electrical current generating tool 30 and a measurement while drilling (MWD) tool 26 including a magnetic field sensor 28, for example, including a tri-axial magnetometer set. In the depicted embodiment, the MWD tool (and therefore sensor 28) is rotationally coupled with the drill string such that it rotates with the drill bit. The MWD tool 26 is further depicted as being deployed just above the drill bit 22. In alternative embodiments, the magnetic field sensors may be deployed in the rotary steerable tool or higher up in the BHA (e.g., above the current generating tool 30. The disclosed embodiments are not limited in this regard.

The electric current generating tool 30 may be a component of the MWD tool, such as in Schlumberger's E-Pulse or E-Pulse Express tool, or may be a stand alone tool. In the depicted embodiment, the electric current generating tool 30 includes an electrically insulating gap 32 across which a voltage may be applied to cause electric current 34 to flow along the length of the drill collar. It should be understood that the electric current generating tool 30 may use substantially any power supply configuration capable of generating the current 34 in the drill collar. The applied voltage may be an alternating (AC) voltage operating, for example, in a frequency range from about 0.1 to about 20 Hz.

When the twin well 40 is in close proximity with the target well 20 (e.g., within about 10 meters), a corresponding electric current may be induced in the target well. For example, in the depicted embodiment, applying a voltage across the insulating gap 32 causes electrical current to flow out into the formation to the target well 40. The electrically conductive casing 42 in the target well 40 provides a path of low resistance which may support an axial current 36 in the target. This current 36 in the target well 40 in turn induces a magnetic field 38 in the formation that is proportional in strength to the magnitude of the current 36. As described in more detail below, measurement of the magnetic field at magnetic field sensor 28 may enable a displacement vector including a distance and direction from the twin well to the target well to be computed.

It will be understood by those of ordinary skill in the art that the deployment depicted on FIG. 1 is merely an example for the purpose of describing the disclosed embodiments set forth herein. For example, the disclosed method embodiments are not limited to the use of an electric current generating tool including an insulating gap. In other embodiments a toroid deployed about the drill string or an electromagnetic antenna may alternatively be used to induce an electric current in the target well casing. An induction device such as disclosed in U.S. Patent Publication 2012/0109527 may also be utilized.

FIG. 1 further includes a diagrammatic representation of a tri-axial magnetometer sensor set. By tri-axial it is meant that the magnetic field sensor includes three mutually perpendicular magnetic field sensors, designated as $B_x$, $B_y$, and $B_z$. By convention, a right handed system is designated in which the z-axis magnetometer ($B_z$) is oriented substantially parallel with the borehole in the downhole direction as indicated (although disclosed embodiments are not limited by such conventions). The magnetometer set may therefore be considered as determining a plane (the x and y-axes) and a pole (the z-axis along the axis of the BHA). By convention, the magnetic field is taken to be positive pointing towards magnetic north. Moreover, also by convention, the y-axis is taken to be the toolface reference axis (i.e., magnetic toolface M equals zero when the y-axis is pointing towards the projection of magnetic north in the xy plane). Those of ordinary skill in the art will readily appreciate that the magnetic toolface M is projected in the xy plane and may be represented mathematically as: $\tan M = B_x/B_y$.

It will be understood that the magnetometer set 28 is not necessarily deployed in MWD tool 26, but may alternatively and/or additionally be deployed in the rotary steerable tool 24. It will also be understood that the disclosed embodiments are not limited to the above described conventions for defining borehole coordinates. Those of ordinary skill in the art will be readily able to utilize other borehole coordinate conventions. Moreover, the disclosed embodiments are not limited to use with an offshore drilling rig as depicted.

Figure 2:
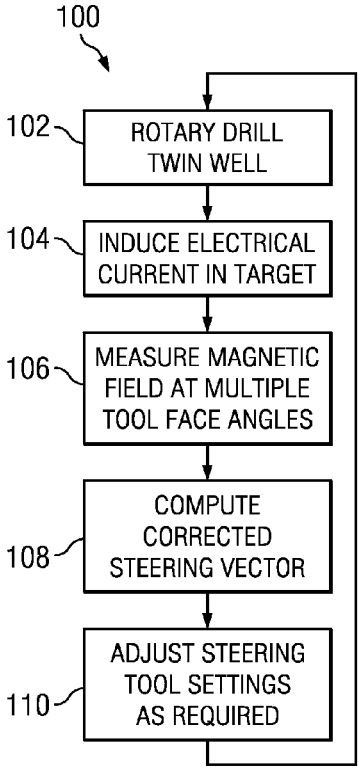
FIG. 2 depicts a flow chart of one disclosed method embodiment.

FIG. 2 depicts a flow chart of one example of a method 100 for closed loop drilling of a twin well (such as that depicted on FIG. 1). The twin well is rotary drilled at 102 using a drill string including a rotary steerable tool. Such rotary drilling may include circulating drilling fluid through the drill string, rotating the drill string at the surface using a top drive, rotary table, or other suitable drilling rig equipment, and advancing the drill string into the borehole as required by the rate of penetration of the subterranean formation. In the disclosed embodiments, a rotary steerable tool is used to control the direction of drilling of the twin well, e.g., via steering the drill bit while drilling. As is known to those of ordinary skill in the art, adjustment of various rotary steerable tool parameters enables the drilling direction to be changed in a predictable and controllable manner while drilling.

At 104 an electrical current is induced in the target well, for example via applying a voltage across an insulating gap in the BHA as described above with respect to FIG. 1. The induced current in turn induces a magnetic field that is measured at multiple tool face angles while the BHA rotates in the twin well at 106. This may be accomplished for example, by measuring the magnetic field substantially continuously while drilling (e.g., at 10 millisecond intervals while drilling). The magnetic field measurements (at the multiple tool face angles) may then be used to compute new rotary steerable tool settings at 108. For example, the magnetic field measurements may be used to compute a displacement vector (a distance and direction) between the twin and target wells which may in turn be compared with a desired displacement vector to obtain a steering vector, which may then by used to compute (or look up) the new settings. The new rotary steerable tool settings may alternatively be obtained derived directly from the magnetic field measurements, e.g., via an onboard look up table. The rotary steerable tool settings may then be adjusted as required at 110 while rotary drilling continues at 102.

It will be understood that substantially any suitable rotary steerable tool may be used in the disclosed method embodiments. Various rotary steerable tool configurations are known in the art. For example, the PathMaker® rotary steerable system (available from PathFinder® a Schlumberger Company), the AutoTrak® rotary steerable system (available from Baker Hughes), and the GeoPilot® rotary steerable system (available from Sperry Drilling Services) include a substantially non-rotating outer housing employing blades that engage the borehole wall. Engagement of the blades with the borehole wall is intended to eccenter the tool body, thereby pointing or pushing the drill bit in a desired direction while drilling. A rotating shaft deployed in the outer housing transfers rotary power and axial weight-on-bit to the drill bit during drilling. Accelerometer and magnetometer sets may be deployed in the outer housing and therefore are non-rotating or rotate slowly with respect to the borehole wall.

The PowerDrive® rotary steerable systems (available from Schlumberger) fully rotate with the drill string (i.e., the outer housing rotates with the drill string). The PowerDrive® Xceed® makes use of an internal steering mechanism that does not require contact with the borehole wall and enables the tool body to fully rotate with the drill string. The PowerDrive® X5 and X6 rotary steerable systems make use of mud actuated blades (or pads) that contact the borehole wall. The extension of the blades (or pads) is rapidly and continually adjusted as the system rotates in the borehole. The PowerDrive® Archer® makes use of a lower steering section joined at a swivel with an upper section. The swivel is actively tilted via pistons so as to change the angle of the lower section with respect to the upper section and maintain a desired drilling direction as the bottom hole assembly rotates in the borehole. Accelerometer and magnetometer sets may rotate with the drill string or may alternatively be deployed in an internal roll-stabilized housing such that they remain substantially stationary (in a bias phase) or rotate slowly with respect to the borehole (in a neutral phase). To drill a desired curvature, the bias phase and neutral phase are alternated during drilling at a predetermined ratio (referred to as the steering ratio).

Figure 3:
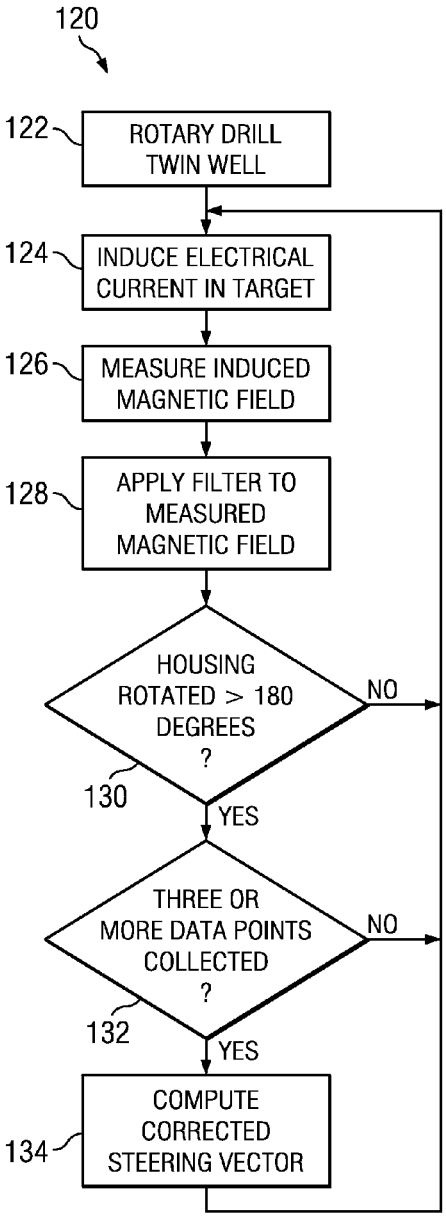
FIG. 3 depicts a flow chart of another disclosed method embodiment.

FIG. 3 depicts a flow chart of another example of a method 120 for closed loop drilling of a twin well. Method 120 is intended for use with a rotary steerable tool including a substantially non-rotating (or slowly rotating) outer blade housing. The magnetic field sensors are deployed in the blade housing and are therefore non-rotating (or slowly rotating) with respect to the borehole wall.

The twin well is rotary drilled at 122. The rotary drilling operation may include circulating drilling fluid through the drill string, rotating the drill string at the surface, and advancing the drill string into the borehole as described above with respect to FIG. 2. In the disclosed embodiments, the rotary steerable tool is used to control the direction of drilling of the twin well.

At 124 an electrical current is induced in the target well, for example, via applying a voltage across an insulating gap in the twin well BHA as described above with respect to FIG. 1. The applied voltage may be an AC voltage, for example, having a frequency of about 10 Hz. The induced current in the target well in turn induces a magnetic field that is measured at 126 while rotary drilling continues. A band pass or high pass filter may optionally be applied to the magnetic field measurements at 128 to remove the earth's magnetic field (which is typically near DC). After a number of magnetic field measurements have been acquired, the measurements may be evaluated at 130 and 132 to determine whether or not at least three measurements have been obtained in a range of toolface angles greater than 180 degrees. If the housing in which the sensors are deployed has rotated at least 180 degrees then new rotary steerable tool settings may be computed at 134. If not, then the method returns to 124 and makes additional magnetic field measurement(s).

In order to facilitate the acquisition of magnetic field measurements over a range of toolface angles, the rotary steerable tool may be controlled in a manner that permits slow rotation of the outer blade housing in the borehole. For example, the pressure (force) applied by at least one of the blades against the borehole wall may be sufficiently low so as to allow the housing to slowly rotate (e.g., at a rotation rate in a range from about 0.5 to about 5 RPM). U.S. Pat. No. 7,950,473, which is fully incorporated by reference herein, discloses techniques for controlling the rotation rate of the blade housing in a rotary steerable tool.

Computing new rotary steerable tool settings may include first computing a displacement vector (i.e., a distance and direction) between the twin well and the target well. The displacement vector may be used to determine a steering vector as described in more detail below with respect to FIG. 4. Alternatively, the new rotary steerable tool settings steering vector may be computed directly from the magnetic field measurements, for example, via processing measured magnetic field in combination with a look-up table to obtain new steering tool settings. The new rotary steerable tool settings may also be obtained directly from the displacement vector (e.g., via the use of a corresponding look-up table).

It will be understood that the induced magnetic field includes distorted and undistorted signal components and at least one noise component. The undistorted signal component is related to the induced magnetic field in the target well (and therefore to the relative position of the twin well with respect to the target well). The distorted signal component being is caused by distortion of the induced magnetic field by rotation of the magnetically permeable BHA. The noise component may result, for example, from the earth's magnetic field. In order to compute the displacement vector or the steering vector, the undistorted signal portion of the measured magnetic field may be isolated from the other components (i.e., the undistorted signal may be isolated from the distorted signal and from the earth's magnetic field). This may be accomplished, for example, via (i) obtaining three or more magnetic field measurements made over a range of toolface angles greater then 180 degrees, (ii) averaging the three or more measurements to obtain an average induced magnetic field (which may be taken to be the undistorted signal component), and (iii) estimating the distance and direction to the target well from the average induced magnetic field. In one embodiment, the three or more magnetic field measurements may be selected such that they are spaced at approximately equal tool face intervals (e.g., at approximately 120 degree intervals for three measurements, at approximately 90 degree intervals for four measurements, at approximately 60 degree intervals for six measurements, and so on).

The displacement vector between the twin well and the target well may be obtained from the undistorted signal component of the measured magnetic field vector. The magnitude of the measured magnetic field tends to be inversely related to the distance between the twin and target wells such that the magnitude increases with decreasing distance. The direction of the measured magnetic field vector indicates the relative direction between the twin and target wells. A displacement vector indicating the distance and direction between the two wells may be represented in magnetic units, for example, including the magnetic field strength and the direction of the vector or alternatively in spatial units including a physical distance and direction between the wells (e.g., a direction from the twin well to the target well). The displacement vector may be readily converted from magnetic units to spatial units, for example, using empirical or theoretical magnetic models, although such conversions are not required.

Figure 4:
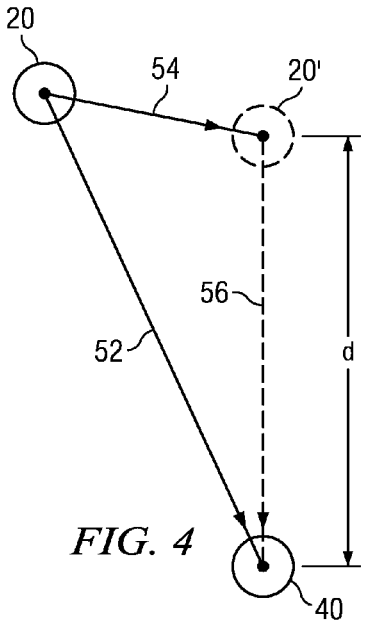
FIG. 4 depicts one example of a method for computing a steering vector.

FIG. 4 depicts a view looking down the axes of the twin 20 and target 40 wells and illustrates one example of a methodology by which a steering vector may be obtained from the displacement vector. The displacement vector between the twin and target wells is shown at 52. FIG. 4 further depicts the desired (or planned) location of the twin well 20' (located directly above the target well at a distance 'd' in this particular embodiment). A steering vector 54 may be obtained, for example, by subtracting the vector 56 between the desired location 20' of the twin well and the target well from the measured displacement vector 52. In this particular embodiment, the steering vector represents the displacement between the actual location of the twin well 20 and the desired location of the twin well 20'.

It will be understood that a one-axis cross-axial magnetic sensor may also be utilized to measure the induced magnetic field in the target well. For example, the one-axis sensor may be rotated one or more revolutions around the tool axis to obtain a peak AC signal direction (e.g., referenced with respect to gravity). The peak AC signal amplitude and direction may then be taken as a magnetic displacement vector and used to obtain the steering vector and/or new rotary steerable tool settings.

Figure 5A:
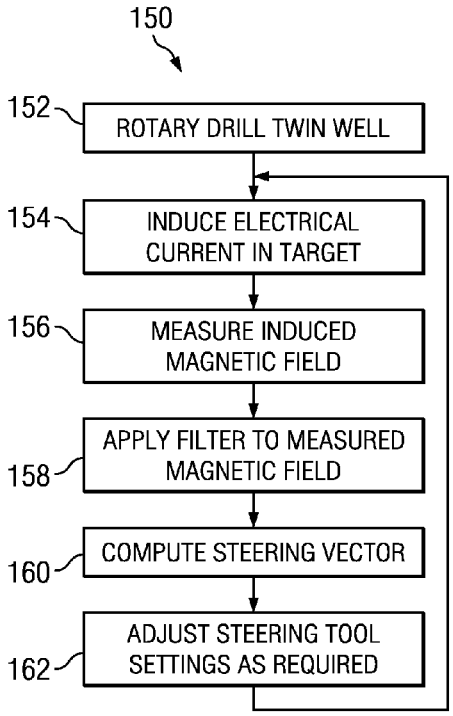
FIG. 5A depicts a flow chart of yet another disclosed method embodiment.

FIG. 5A depicts a flowchart of yet another disclosed method embodiment 150. Method 150 is intended for use with a rotary steerable tool that rotates with the drill string. Method 150 may be used with a rotary steerable tool in which the magnetic field sensors are deployed in a housing that is rotationally coupled with the drill string or alternatively in a roll-stabilized housing. The magnetic field sensors may also be deployed in a separate MWD tool deployed above or below the rotary steerable tool in the BHA. When deployed in a roll-stabilized housing, sensors may be stationary with respect to the borehole or rotate relatively slowly with respect to the borehole (as compared to the rotation rate of the BHA). Method 150 is similar to method 120 in that the twin well is rotary drilled at 152 using a BHA including a rotary steerable tool. The rotary drilling operation may include circulating drilling fluid through the drill string, rotating the drill string at the surface, and advancing the drill string into the borehole as described above with respect to FIG. 2. The rotary steerable tool is used to control the direction of drilling of the twin well.

At 154 an electrical current is induced in the target well, for example, via applying a voltage across an insulating gap in the twin well BHA as described above with respect to FIG. 1. The applied voltage may be an AC voltage, for example, having a frequency of about 10 Hz. The induced current in turn induces a magnetic field that is measured at 156 while rotary drilling continues. Magnetic field measurements may be made at substantially any suitable time interval during drilling (e.g., at 10 millisecond intervals—corresponding to a measurement frequency of 100 Hz). Upon acquiring a large number of measurements (e.g., 1000 measurements made over a 10 second time period or 6000 measurements made over a 60 second time period or some other suitable number of measurements), a band pass filter may be applied to the measurements at 158 to obtain the undistorted signal component of the magnetic field. For example a band pass filter having a narrow pass band around 10 Hz may be utilized when the voltage applied across the insulating gap has a frequency of 10 Hz. Those of ordinary skill in the art will readily be able to design suitable filters for substantially any suitable pass band. The obtained signal component may then be used to compute new rotary steerable tool settings at 160 which may then be applied at 162 to change the direction of drilling the twin well.

Figure 5B:
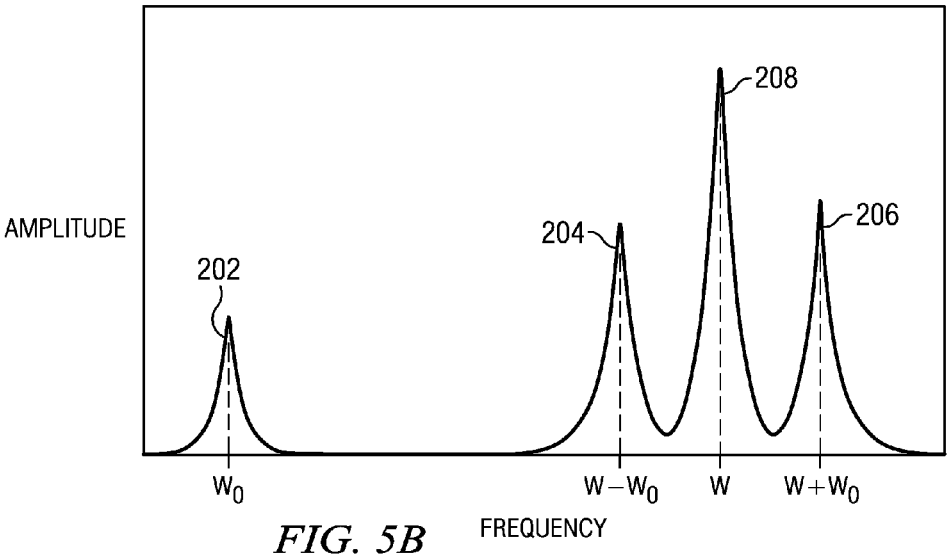
FIG. 5B depicts an example of a magnetic field power spectrum obtained while using the method shown on FIG. 5A.

FIG. 5B depicts a hypothetical example of a power spectrum of the magnetic field measurements made at 156 (those of ordinary skill in the art will readily appreciate that a power spectrum is a plot of power as a function of frequency). In the depicted embodiment, the applied voltage has a frequency of $\omega$ while the rotary steerable tool (including the sensors which may be deployed in the rotary steerable tool or elsewhere in the BHA) rotates with respect to the borehole at a frequency of $\omega_o$. Four peaks are indicated in the depicted spectrum. The earth's magnetic field is indicated at 202 centered at a frequency of $\omega_o$. First and second noise peaks (i.e., distorted signal peaks due to distortion of the induced magnetic field caused by rotation of the BHA) are depicted at 204 and 206. These peaks are centered at corresponding frequencies $\omega-\omega_o$ and $\omega+\omega_o$ (i.e., the signal frequency $\omega$ modulated by the rotation rate of the BHA $\omega_o$). The undistorted signal peak due to the induced magnetic field is depicted at 208 and shown centered at frequency $\omega$. As described in more detail below with respect to FIGS. 7A, 7B, and 7C, application of the filter at 158 is intended to remove the earth's magnetic field 202 as well as the distorted signal peaks 204 and 206 so as to isolate the undistorted signal peak 208.

Figure 6A:
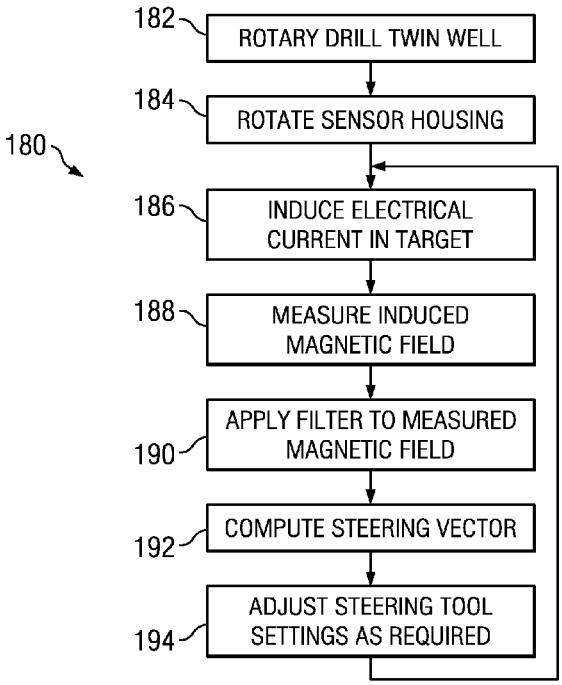
FIG. 6A depicts a flow chart of still another disclosed method embodiment.

FIG. 6A depicts a flowchart of still another disclosed method embodiment 180. Method 180 is intended for use with a rotary steerable tool in which the magnetic field sensors are deployed in a roll-stabilized housing. Being deployed in a roll-stabilized housing the magnetic field sensors may be non-rotating with respect to the borehole (e.g., in the bias phase) or may rotate slowly with respect to the borehole (e.g., in the neutral phase). The rotation rate in the neutral phase is much less than that of the BHA and other rotary steerable tool components (e.g., in a range from about 1 to about 5 revolutions per minute). For example, in one embodiment the BHA may rotate at 120 revolutions per minute (2 Hz) while the sensors may rotate at −3 revolutions per minute (i.e., in the opposite direction as the BHA). The disclosed embodiments are of course not limited to any particular rotation rates of the BHA and roll-stabilized housing.

Method 180 is similar to method 120 in that the twin well is rotary drilled at 182 using a BHA including a rotary steerable tool. The rotary drilling operation may include circulating drilling fluid through the drill string, rotating the drill string at the surface, and advancing the drill string into the borehole as described above with respect to FIG. 2. The rotary steerable tool is used to control the direction of drilling of the twin well. In embodiments in which the roll-stabilized housing rotates at a non-zero rate with respect to the borehole, the roll-stabilized housing may initiate rotation at 184.

An electrical current may be induced in the target well at 186, for example, via applying a voltage across an insulating gap in the twin well BHA as described above with respect to FIG. 1. The applied voltage may be an AC voltage, for example, having a frequency of about 10 Hz. The induced current in turn induces a magnetic field that is measured at 188 while rotary drilling continues. As described above, magnetic field measurements may be made at substantially any suitable time interval during drilling (e.g., at 10 millisecond intervals—corresponding to a measurement frequency of 100 Hz). Upon acquiring a large number of measurements (e.g., 1000 measurements made over a 10 second time period), a band pass filter may be applied to the measurements at 190 to obtain (or isolate) the undistorted signal component of the magnetic field. For example a band pass filter having a narrow pass band around 10 Hz may be utilized when the voltage applied across the insulating gap has a frequency of 10 Hz. Those of ordinary skill in the art will readily be able to design suitable filters for substantially any suitable pass band. The obtained undistorted signal component may then be used to compute new rotary steerable tool settings at 192 which may be applied at 194 to change the direction of drilling.

Figure 6B:
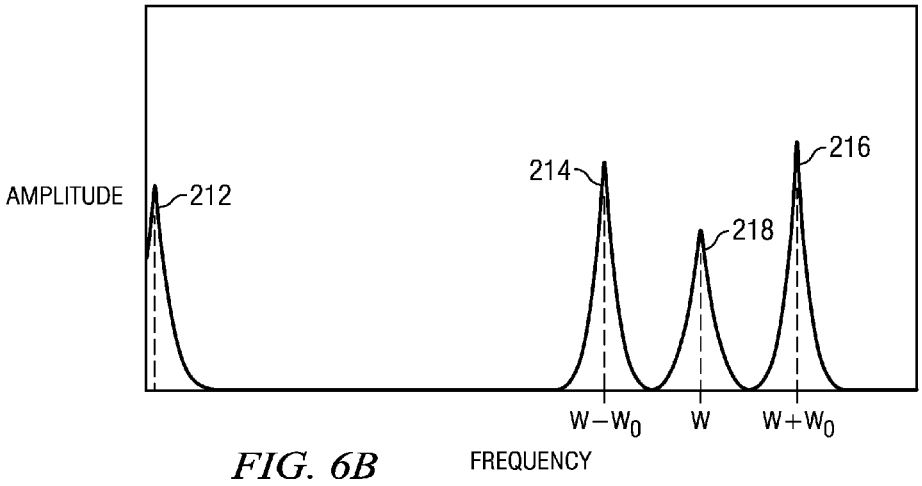
FIG. 6B depicts another example of a magnetic field spectrum obtained while using the method shown on FIG. 5B.

FIG. 6B depicts a hypothetical example of a power spectrum of the magnetic field measurements made at 188 when the tool is in the neutral phase (i.e., when the roll-stabilized housing rotates slowly with respect to the borehole). In the depicted embodiment, the applied voltage has a frequency of $\omega$ while the BHA rotates with respect to the borehole at a frequency of $\omega_o$. The magnetic field sensors rotate slowly (e.g., at −3 RPM) as compared to the BHA. Four peaks are indicated in the depicted spectrum. The earth's magnetic field is indicated at 212 and is centered at a near zero frequency owing to the slow rotation rate of the sensors (as compared to the spectrum depicted on FIG. 5B in which the earth's magnetic field is centered at the sensor/BHA rotation rate). First and second noise peaks (distorted signal peaks due to the rotation of the BHA) are depicted at 214 and 216. These peaks are centered at corresponding frequencies $\omega-\omega_o$ and $\omega+\omega_o$ as described above with respect to FIG. 5B. As depicted, the distorted signal peaks 214 and 216 are somewhat larger than those depicted on FIG. 5B at 204 and 206 since the BHA rotates with respect to the sensors in rotary steerable tool embodiments employing a roll-stabilized housing. The undistorted signal peak is depicted at 218 and shown centered at frequency $\omega$. As described in more detail below with respect to FIGS. 7A, 7B, and 7C, application of the filter at 190 is intended to remove the earth's magnetic field 212 as well as the noise peaks 214 and 216 so as to isolate the undistorted signal peak 218.

Figure 7A:
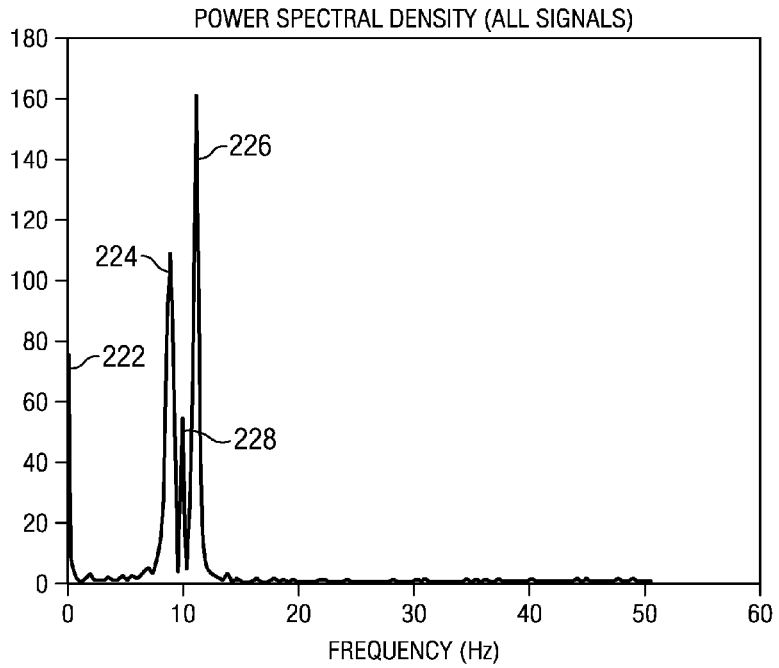
FIGS. 7A, 7B, and 7C depict an example of the method embodiment show on FIG. 6A.
Figure 7C:
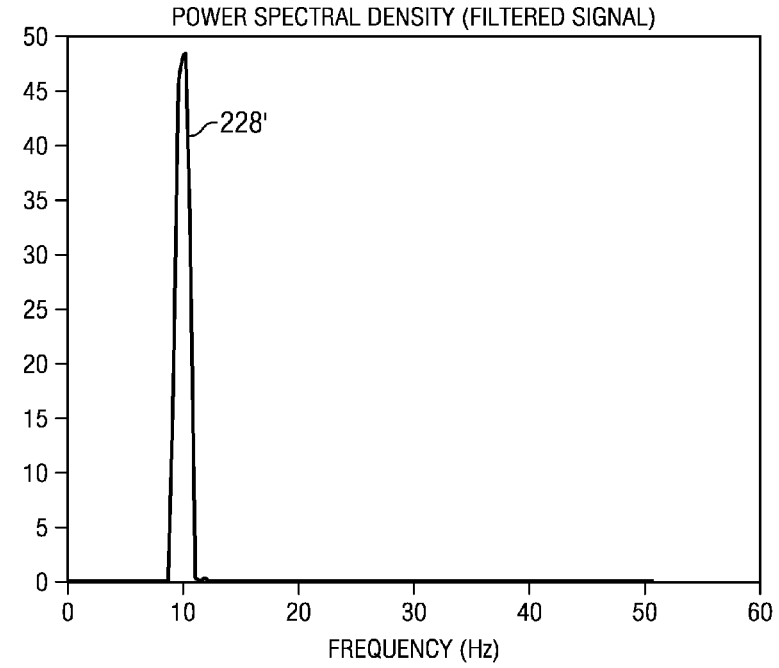
Figure 7B:
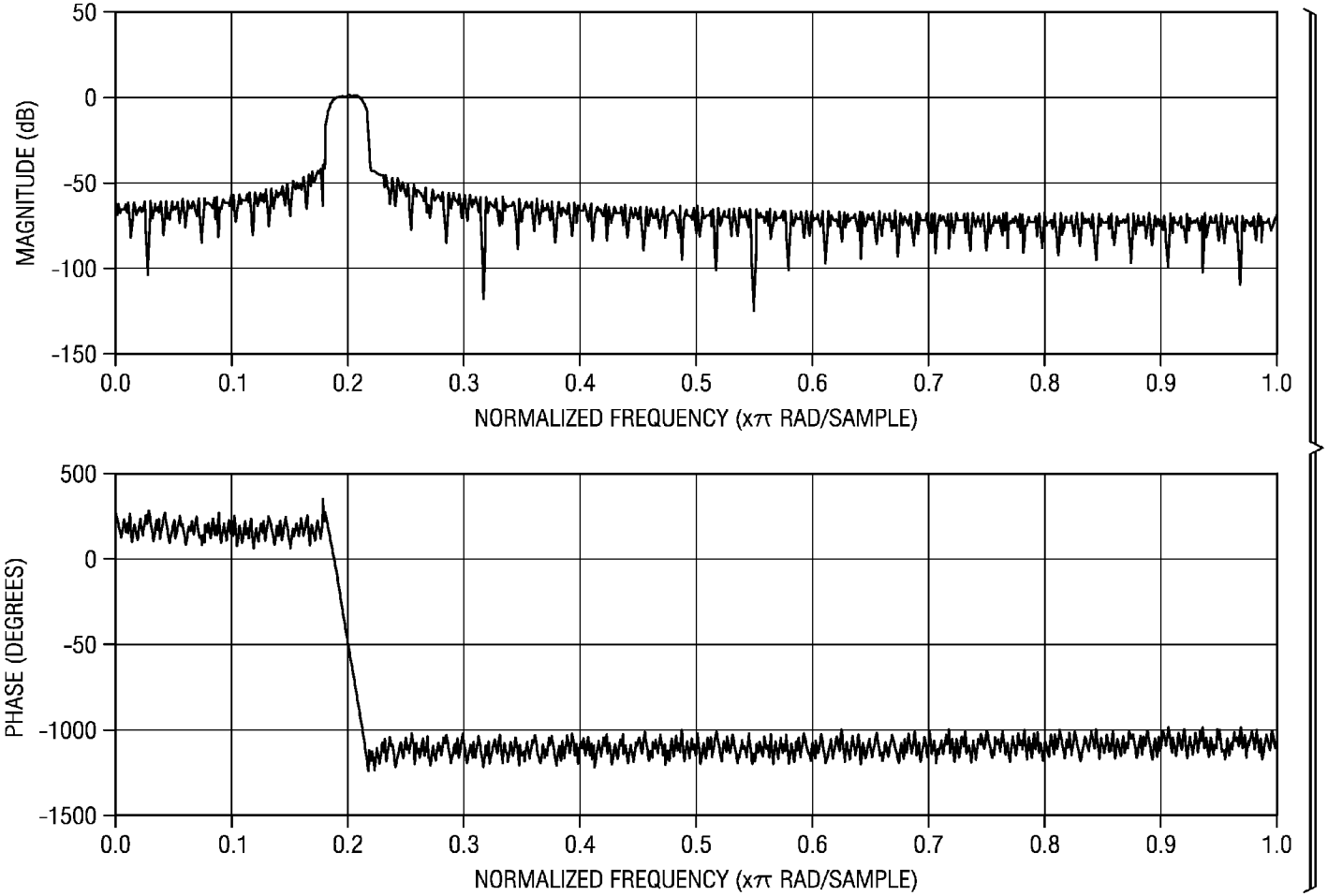

FIGS. 7A, 7B, and 7C depict one example of the application of method 180. In this particular example, the BHA rotation rate was 60 revolutions per minute (1 Hz). The rotation rate of the roll-stabilized housing was −3 revolutions per minute. The induced magnetic field had a frequency of 10 Hz. FIG. 7A is similar to FIG. 6B in that it depicts a plot of the power spectral density of the magnetic field measurements made at 188. The earth's magnetic field component is shown at 222 having a center frequency at about 0 Hz. The noise peaks caused by BHA distortion are depicted at 224 and 226 having center frequencies of 9 and 11 Hz (i.e., modulated at frequencies of 10−1 and 10+1 Hz). The signal component is depicted at 228 having a center frequency of 10 Hz. FIG. 7B depicts one example of a finite impulse response (FIR) filter having a center frequency of 10 Hz and a bandwidth (i.e., a pass band) of 1 Hz from 9.5 to 10.5 Hz. In the depicted filter embodiment the frequency is normalized such that unity represents 50 Hz (and such that the center frequency of 0.2 corresponds to 10 Hz). FIG. 7C depicts the undistorted signal component obtained upon filtering the data depicted on FIG. 7A with the FIR filter depicted on FIG. 7B. The obtained undistorted signal component 228' may be processed as described above to obtain a displacement vector and/or a steering vector. It will be understood that the disclosed embodiments are not limited to the use of an FIR filter. Other types of digital filters (e.g., infinite impulse response filters) and even analog filters may be utilized.

The filter (e.g., the FIR filter) may be applied, for example, to the x- and y-axis magnetic field measurements (e.g., at 10 second intervals including 1000 measurements each). In a closed loop well twinning operation, the demand toolface and the steering ratio of the rotary steerable tool (the ratio of the bias and neutral phases) may be automatically adjusted in a closed loop manner based on the magnitudes of the filtered x- and y-axis magnetic field measurements at 10 Hz. For example, a look-up table may be constructed based on a mathematical model and certain steering strategy considerations. The x- and y-axis magnetic field measurements may then be evaluated with the look up table to obtain new steering tool settings (e.g., bias and neutral phase times and ratio).

It will be understood that while not shown in FIG. 1, BHAs and/or rotary steerable tools suitable for use with the disclosed embodiments generally include at least one electronic controller. Such a controller may include signal processing circuitry including a digital processor (a microprocessor), an analog to digital converter, and processor readable memory. The controller may also include processor-readable or computer-readable program code embodying logic, including instructions for making, processing, and filtering magnetic field measurements. One skilled in the art will also readily recognize the aforementioned filtering operations may be applied using either hardware or software mechanisms.

A suitable controller may include a timer including, for example, an incrementing counter, a decrementing time-out counter, or a real-time clock. The controller may further include multiple data storage devices, various sensors, other controllable components, a power supply, and the like. The controller may also optionally communicate with other instruments in the drill string, such as telemetry systems that communicate with the surface or an EM (electro-magnetic) shorthop that enables the two-way communication across a downhole motor. It will be appreciated that the controller is not necessarily located in the rotary steerable tool, but may be disposed elsewhere in the drill string in electronic communication therewith. Moreover, one skilled in the art will readily recognize that the multiple functions described above may be distributed among a number of electronic devices (controllers).

In one example embodiment, a closed loop method for drilling a twin well along a predetermined path with respect to a target well, the target well being cased with a metallic liner, the method comprising: (a) rotary drilling the twin well using a drill string including a drill bit, a current generating tool, a rotary steerable tool, and a magnetic field sensor; (b) inducing an electrical current in the target well liner using the current generating tool while rotary drilling in (a), said induced electrical current resulting in a magnetic field about the target well; (c) making a plurality of magnetic field measurements using the magnetic field sensor while rotary drilling in (a); (d) processing the plurality of magnetic field measurements made in (c) to obtain new rotary steerable tool settings; and (e) changing a direction of rotary drilling using the new steering tool settings obtained in (d).

Although closed loop well twinning methods and certain advantages thereof have been described in detail, it should be understood that various changes, substitutions and alternations can be made herein without departing from the spirit and scope of the disclosure as defined by the appended claims.

What is claimed is:

1. A closed loop method for drilling a twin well along a predetermined path with respect to a target well, the target well being cased with a metallic liner, the method comprising:

(a) rotary drilling the twin well using a drill string comprising a drill bit, a rotary steerable tool, a controller disposed in the drill string and a magnetic field sensor wherein the rotary steerable tool comprises a substantially non-rotating outer blade housing having a rotating shaft deployed in the outer blade housing and a plurality of blades that engage a borehole, and the magnetic field sensor is deployed in the outer blade housing and is stationary or rotates relatively slowly with respect to the borehole while advancing into the borehole and the plurality of blades continually adjusted during drilling;

(b) inducing an electrical current in the target well, said induced electrical current resulting in a magnetic field about the target well;

(c) measuring the magnetic field substantially continuously while drilling at multiple tool face angles;

(d) processing the plurality of magnetic field measurements made in (c) in the controller to obtain a displacement vector; processing the displacement vector to obtain a steering vector; processing the steering vector to obtain new rotary steerable tool settings; and (e) adjusting the drilling direction o using the new steering tool settings without stopping the rotary drilling or removing the drill string.

2. The method of claim 1, wherein rotary drilling in (a) comprises:

(i) circulating drilling fluid through the drill string so as to rotate the drill bit;

(ii) rotating the drill string; and (iii) advancing the drill string into the twin well.

3. The method of claim 1, wherein the magnetic field sensor comprises a tri-axial magnetic field sensor.

4. The method of claim 1, wherein (d) further comprises processing the plurality of magnetic field measurements in combination with a look-up table to obtain the new rotary steerable tool settings.

5. A closed loop method for drilling a twin well along a predetermined path with respect to a target well, the target well being cased with a metallic liner, the method comprising:

rotary drilling the twin well using a drill string comprising a drill bit, a rotary steerable tool, a controller disposed in the drill string and a magnetic field sensor wherein the rotary steerable tool comprises a substantially non-rotating outer blade housing having a rotating shaft deployed in the outer blade housing and a plurality of blades that engage a borehole, and the magnetic field sensor is deployed in the outer blade housing and is stationary or rotates relatively slowly with respect to the borehole while advancing into the borehole and the plurality of blades continually adjusted during drilling;

(b) inducing an electrical current in the target well, said induced electrical current resulting in a magnetic field about the target well;

(c) measuring substantially continuously at least three magnetic field measurements using the magnetic field sensor while rotary drilling, the at least three magnetic field measurement being made over a range of toolface angles greater than 180 degrees;

(d) computing an average of at least three magnetic field measurements made to obtain an average magnetic field measurement;

(e) processing in the controller the average magnetic field measurement to obtain a displacement vector; processing the displacement vector to obtain a steering vector; processing the steering vector to obtain new rotary steerable tool settings; and (f) adjusting a direction of rotary drilling using the new steering tool settings without stopping the rotary drilling or removing the drill string.

6. The method of claim 5, wherein the current generating tool comprises an insulating gap.

7. The method of claim 5, wherein rotary drilling in (a) comprises:

(i) circulating drilling fluid through the drill string so as to rotate the drill bit;

(ii) rotating the drill string; and (iii) advancing the drill string into the twin well.

8. The method of claim 5, wherein the average magnetic field measurement is processed in combination with a look-up table to obtain the new rotary steerable tool settings.

9. A closed loop method for drilling a twin well along a predetermined path with respect to a target well, the target well being cased with a metallic liner, the method comprising:

(a) rotary drilling the twin well using a drill string comprising a drill bit, a current generating tool, a rotary steerable tool, a controller disposed in the drill string and a magnetic field sensor, the rotary steerable tool comprising an outer blade housing having a rotating shaft deployed in the outer blade housing and a plurality of blades that engage a borehole, wherein the magnetic field sensor is deployed in the outer blade housing and the plurality of blades continually adjust during drilling;

(b) inducing an electrical current in the target well liner using the current generating tool while rotary drilling, said induced electrical current resulting in a magnetic field about the target well;

(c) measuring the magnetic field substantially continuously while drilling at multiple tool face angles;

(d) applying a band pass filter to the plurality of magnetic field measurements to obtain an undistorted signal component of the magnetic field measurements;

(e) processing the undistorted signal component of the magnetic field measurements to obtain a displacement vector; processing the displacement vector to obtain a steering vector; processing the steering vector to obtain new rotary steerable tool settings; and (f) adjusting the drilling direction o using the new steering tool settings without stopping the rotary drilling or removing the drill string.

10. The method of claim 9, wherein the current generating tool comprises an insulating gap.

11. The method of claim 9, wherein rotary drilling in (a) comprises:

(i) circulating drilling fluid through the drill string so as to rotate the drill bit;

(ii) rotating the drill string; and (iii) advancing the drill string into the twin.

12. The method of claim 11, wherein the magnetic field sensor rotates with the drill string during rotary drilling.

13. The method of claim 9, wherein (e) further comprises processing the undistorted signal component of the magnetic field measurements in combination with a look-up table to obtain the new rotary steerable tool settings.

14. A closed loop method for drilling a twin well along a predetermined path with respect to a target well, the target well being cased with a metallic liner, the method comprising:

(a) rotary drilling the twin well using a drill string including a drill bit, a current generating tool, a rotary steerable tool, and a magnetic field sensor deployed in a roll-stabilized housing in the rotary steerable tool, said rotary drilling causing the rotary steerable tool to rotate at a first rate with respect to the borehole;

(b) rotating the roll-stabilized housing in the rotary steerable tool while rotary drilling in (a) thereby causing the magnetic field sensor to rotate at a second rate with respect to the borehole, wherein the second rate is less than the first rate;

(c) inducing an electrical current in the target well liner using the current generating tool while rotary drilling, said induced electrical current resulting in a magnetic field about the target well;

(d) making a plurality of magnetic field measurements using the magnetic field sensor while rotary drilling;

(e) applying a band pass filter to the plurality of magnetic field measurements to obtain an undistorted signal component of the magnetic field measurements;

(f) processing the undistorted signal component of the magnetic field measurements to obtain a displacement vector; processing the displacement vector to obtain a steering vector; processing the steering vector to obtain new rotary steerable tool settings; and (g) changing a direction of rotary drilling using the new steering tool settings obtained.

15. The method of claim 14, wherein the current generating tool comprises an insulating gap.

16. The method of claim 14, wherein rotary drilling in (a) comprises:

(i) circulating drilling fluid through the drill string so as to rotate the drill bit;

(ii) rotating the drill string; and (iii) advancing the drill string into the twin well.

17. The method of claim 16, wherein (b) comprises rotating the role-stabilized housing in a direction opposite to the drill string during rotary drilling.

18. The method of claim 14, wherein (f) further comprises processing the undistorted signal component of the magnetic field measurements in combination with a look-up table to obtain the new rotary steerable tool settings.

* * * * *